US011553270B2

(12) United States Patent
Jordanov

(10) Patent No.: US 11,553,270 B2
(45) Date of Patent: Jan. 10, 2023

(54) NOISE ATTENUATING HEADPHONES

(71) Applicant: Martin Jordanov, Nashville, TN (US)

(72) Inventor: Martin Jordanov, Nashville, TN (US)

( * ) Notice: Subject to any disclaimer, the term of this patent is extended or adjusted under 35 U.S.C. 154(b) by 0 days.

(21) Appl. No.: 17/376,287

(22) Filed: Jul. 15, 2021

(65) Prior Publication Data

US 2022/0400332 A1 Dec. 15, 2022

Related U.S. Application Data

(60) Provisional application No. 63/208,762, filed on Jun. 9, 2021.

(51) Int. Cl.

| | |
|---|---|
| ***A47G 9/10*** | (2006.01) |
| ***H04R 1/10*** | (2006.01) |
| *A47G 9/00* | (2006.01) |

(52) U.S. Cl.

CPC ..... *H04R 1/1083* (2013.01); *A47G 9/1045* (2013.01); *A47G 2009/006* (2013.01); *H04R 2201/023* (2013.01)

(58) Field of Classification Search

CPC ..... H04R 1/1083; H04R 2201/023; A47G 9/1045; A47G 2009/006

USPC ..... 381/74

See application file for complete search history.

(56) References Cited

U.S. PATENT DOCUMENTS 8,358,799 B1 * 1/2013 Gresko ..... H04R 1/1058 381/372

2020/0202839 A1 * 6/2020 Asada ..... G10K 11/17857

FOREIGN PATENT DOCUMENTS

CN 102473407 B * 12/2013 ..... G10K 11/178

* cited by examiner

*Primary Examiner* — Vivian C Chin

*Assistant Examiner* — Friedrich Fahnert

(74) *Attorney, Agent, or Firm* — Mitchell Law PLLC; Matthew W. Mitchell

(57) ABSTRACT

Ambient noise attenuating headphones are disclosed that may be used when a user is laying down on their side. The headphones include an ergonomic support structure, a noise attenuating structure housed within the ergonomic support structure having a circumferential end configured to surround an ear of the user, wherein the noise attenuating structure comprises a first and second elastic portion, and wherein the second elastic portion has the circumferential end having a material density less than the first elastic portion, and a speaker coupled to the noise attenuating structure.

16 Claims, 26 Drawing Sheets

NOISE ATTENUATING HEADPHONES

TECHNICAL FIELD

This disclosure relates to headphones, and more particularly to noise attenuating headphones that may be used when laying down on a side.

BACKGROUND

The statements in this section merely provide background information related to the present disclosure and may not constitute prior art.

There are many types of headphones intended to maximize comfort and even a few intended for use when sleeping. The existing known headphones, however, have some limitations. These known headphones still include some level of discomfort when pressure is applied to the ear, which can be exacerbated when used for extended time periods such as occurs before or during sleep.

Some known over-the-ear headphones do a good job of blocking external noise while delivering high quality, stereo sound into the ears. They can be designed to be comfortable when worn upright. One can even wear them to bed while laying on one's back. However, most people can lay on their back for a limited amount of time. After a while, most people choose to turn on their side and that's when over the ear headphones have to come off. These known headphones are simply painful or highly uncomfortable while laying on your side.

There are also some known pillows with embedded speakers. These pillow speakers are disadvantaged, however, in that they are flat and do not do a good job of blocking environmental noises or delivering high quality stereo sound into the ears, as only one ear can hear sound at a time, while the other ear is exposed to environmental noise. If the person is laying on their back over that kind of pillow, both ears could hear sound but both ears are also exposed to environmental noises.

Hence, a need exists for comfortable, noise attenuating headphones that can deliver high quality stereo sound into each ear while mitigating environmental noise into each ear.

SUMMARY

Ambient noise attenuating headphones are disclosed that may be used when a user is laying down on their side. The headphones include an ergonomic support structure, a noise attenuating structure housed within the ergonomic support structure having a circumferential end configured to surround an ear of the user, wherein the noise attenuating structure comprises a first and second elastic portion, and wherein the second elastic portion has the circumferential end having a material density less than the first elastic portion, and a speaker coupled to the noise attenuating structure.

Certain embodiments of the first and second elastic portions are formed of silicone material having different firmness from having been formed of different material densities.

Certain embodiments of the ergonomic support structure are pillow-like.

This summary is provided merely to introduce certain concepts and not to identify key or essential features of the claimed subject matter.

BRIEF DESCRIPTION OF THE DRAWINGS

One or more embodiments will now be described, by way of example, with reference to the accompanying drawings, in which.

DETAILED DESCRIPTION

Figure 1:
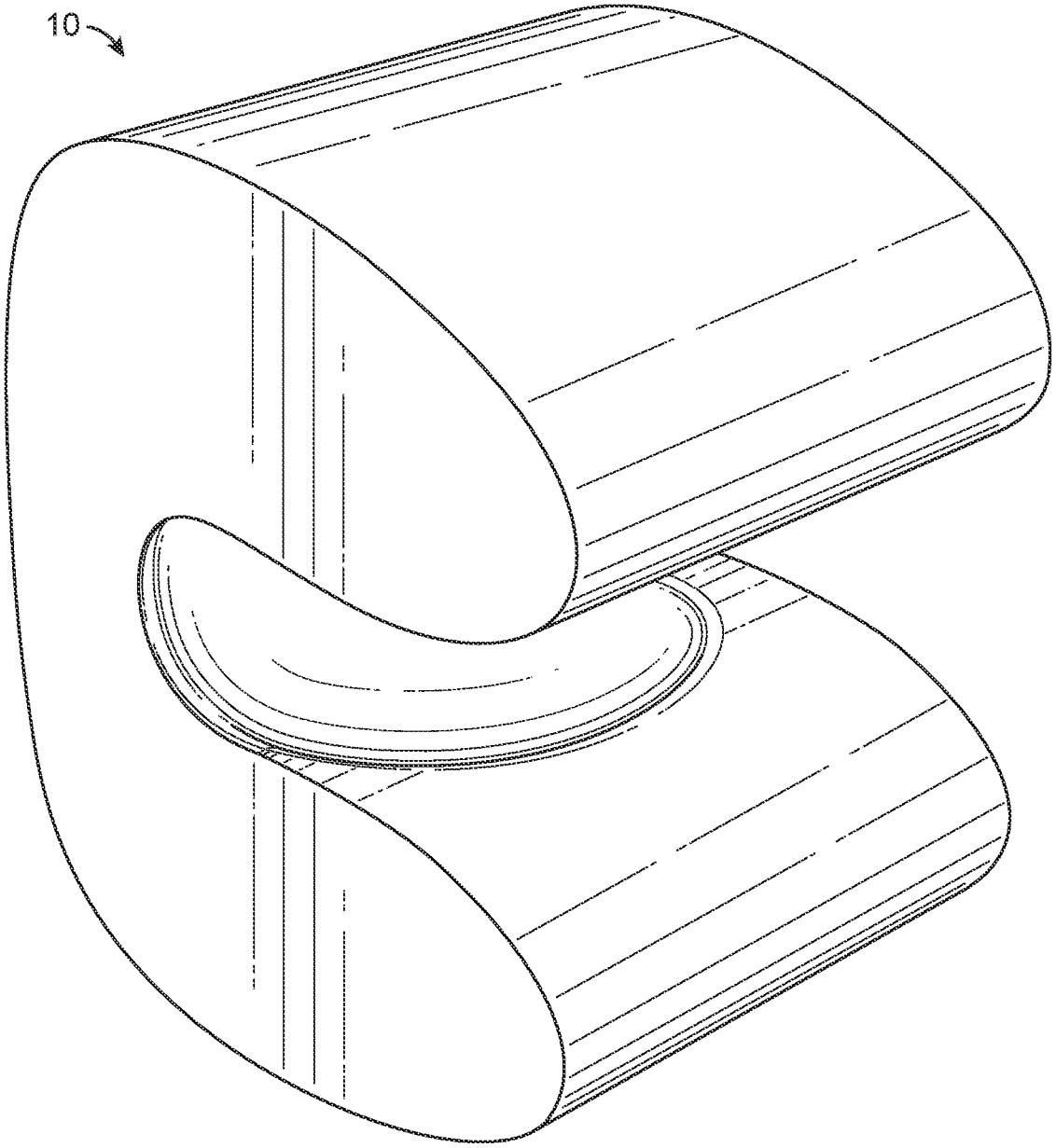
FIG. 1 is a perspective view of exemplary headphones, in accordance with the present disclosure.
Figure 2:
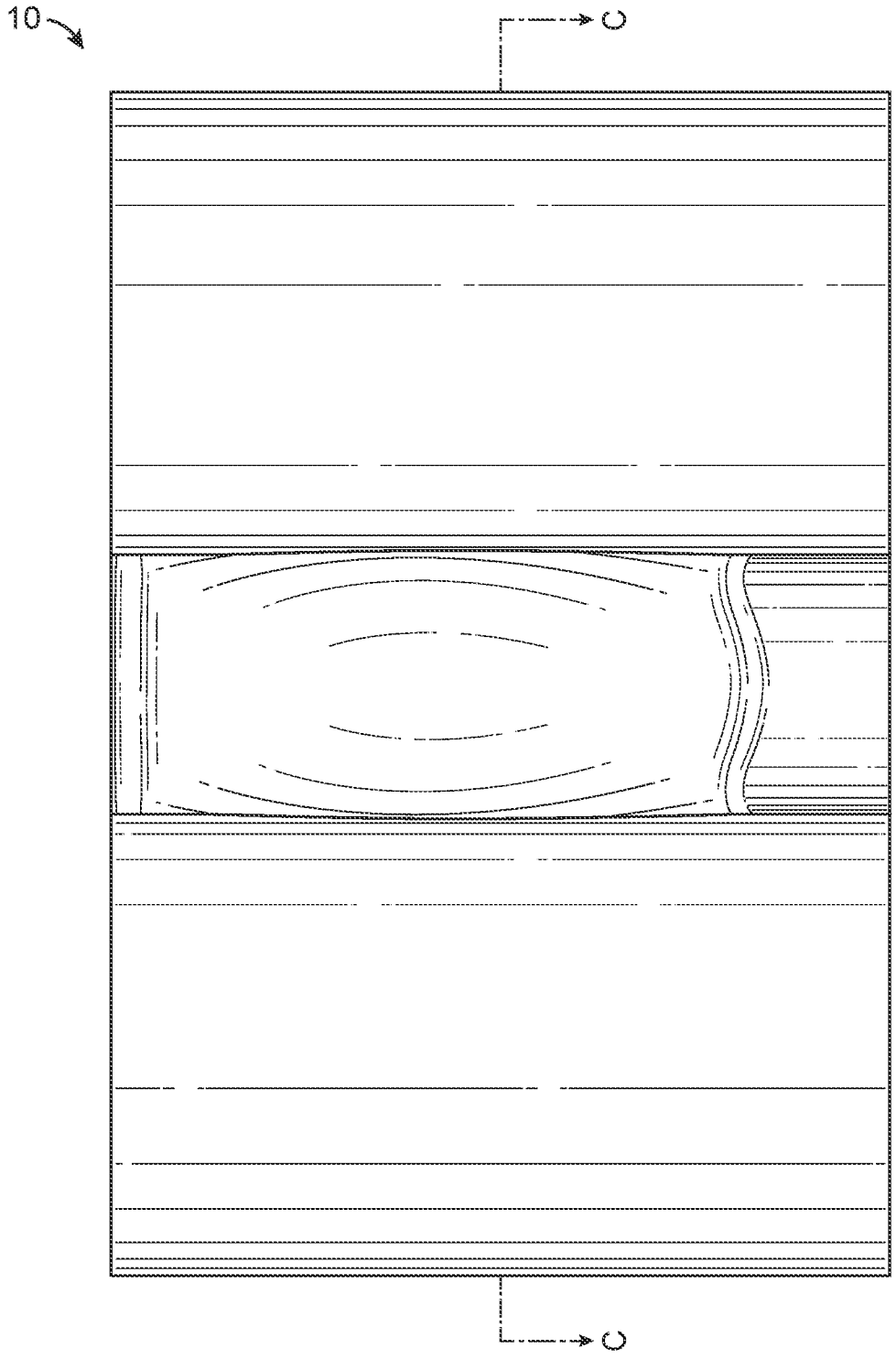
FIG. 2 is a front view of the exemplary headphones, in accordance with the present disclosure.
Figure 3:
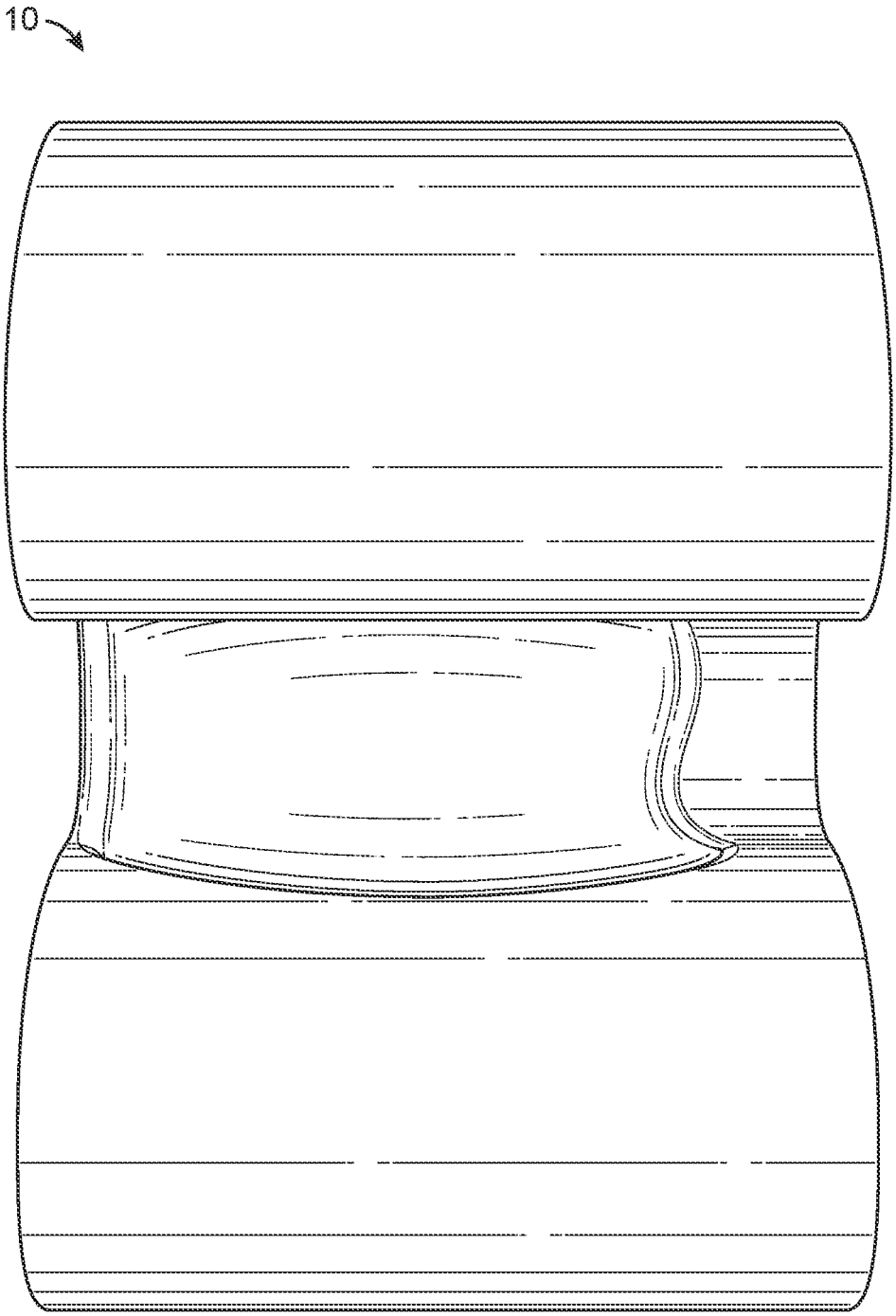
FIGS. 3-4 show the exemplary headphones slightly askew relative to the front view, in accordance with the present disclosure.
Figure 4:
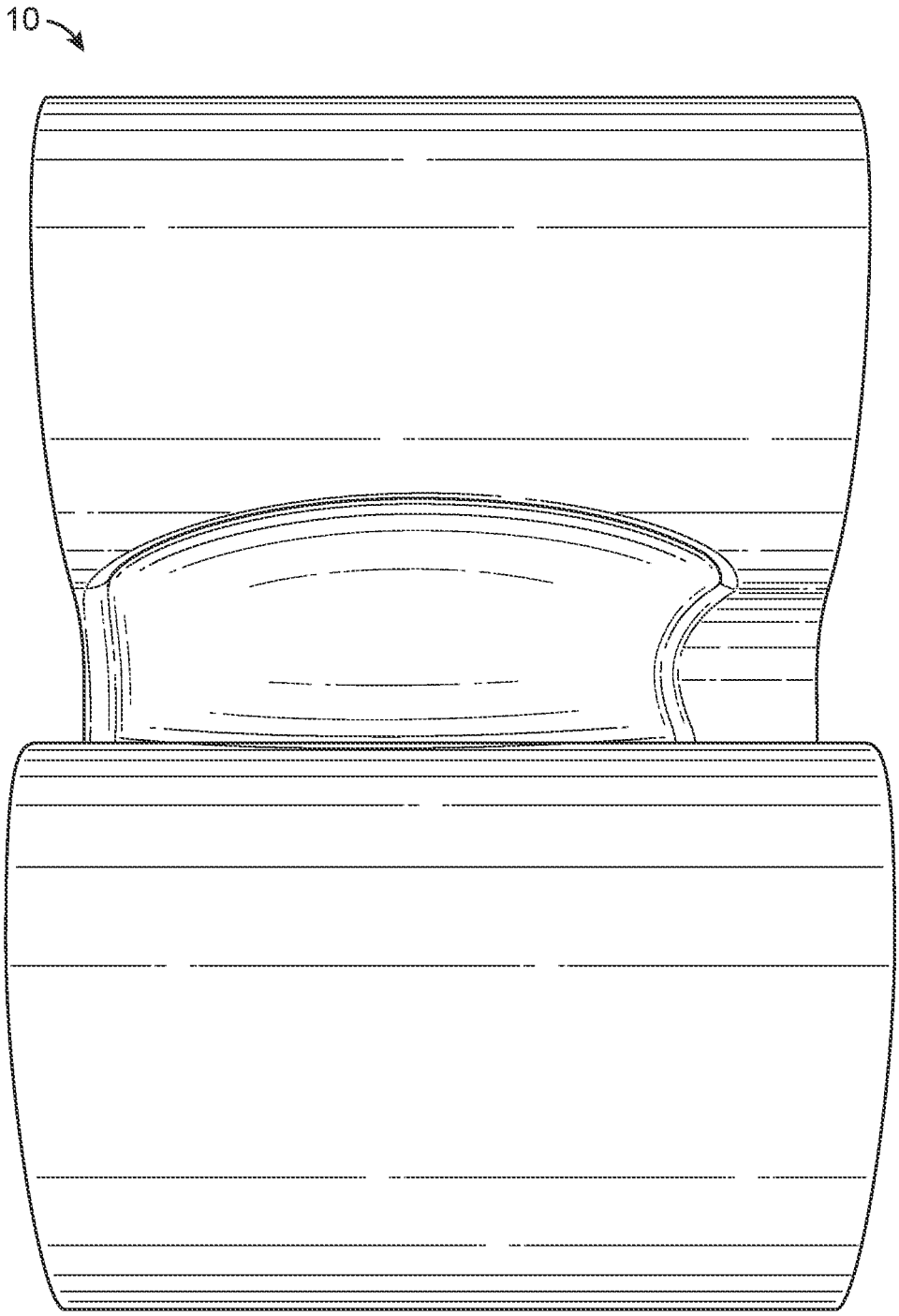

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

As used in the description herein and throughout the claims, the following terms take the meanings explicitly associated herein, unless the context clearly dictates otherwise: the meaning of "a," "an," and "the" includes plural reference, the meaning of "in" includes "in" and "on." The term "based upon" is not exclusive and allows for being based on additional factors not described, unless the context clearly dictates otherwise. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner.

Referring now to the drawings, wherein the depictions are for the purpose of illustrating certain exemplary embodiments only and not for the purpose of limiting the same, FIGS. 1-5 shows an exemplary assembled noise mitigating headphones 10. As FIGS. 1-5 show, the headphones 10 are preferably shaped and sized to encompass a user's head or most of a user's head. In so encompassing most or all of a user's head, the headphones 10 will encompass a user's ears.

With specific reference to FIG. 1, the headphones 10 can include a strap that may be used to pull ends of the headphone toward one another and help couple the headphones 10 to the user's ears to further attenuate outside ambient noise.

Figure 6A:
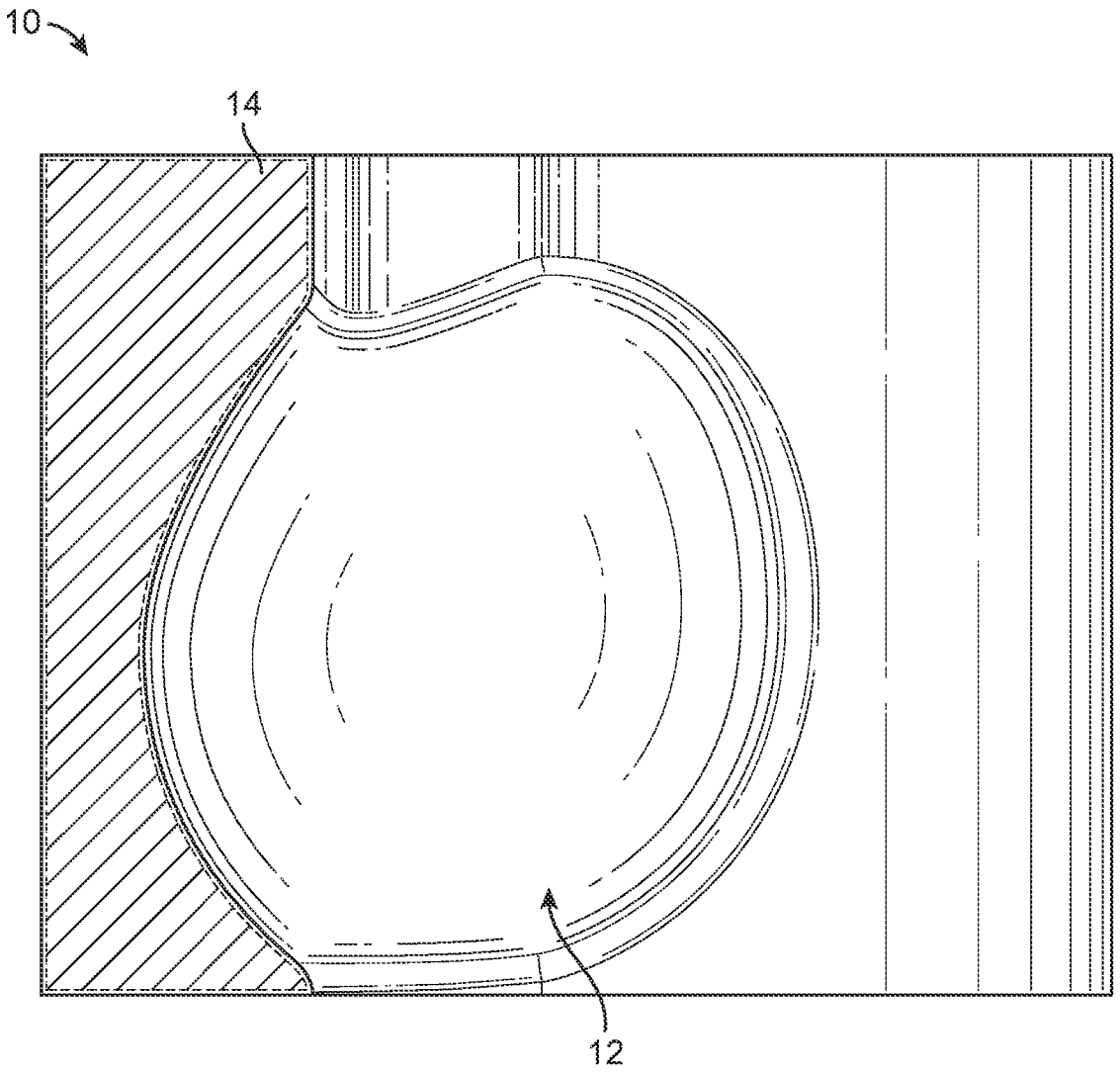
FIGS. 6A-6B are cross-sectional views along the line A-A of FIG. 5, in accordance with the present disclosure.
Figure 6B:
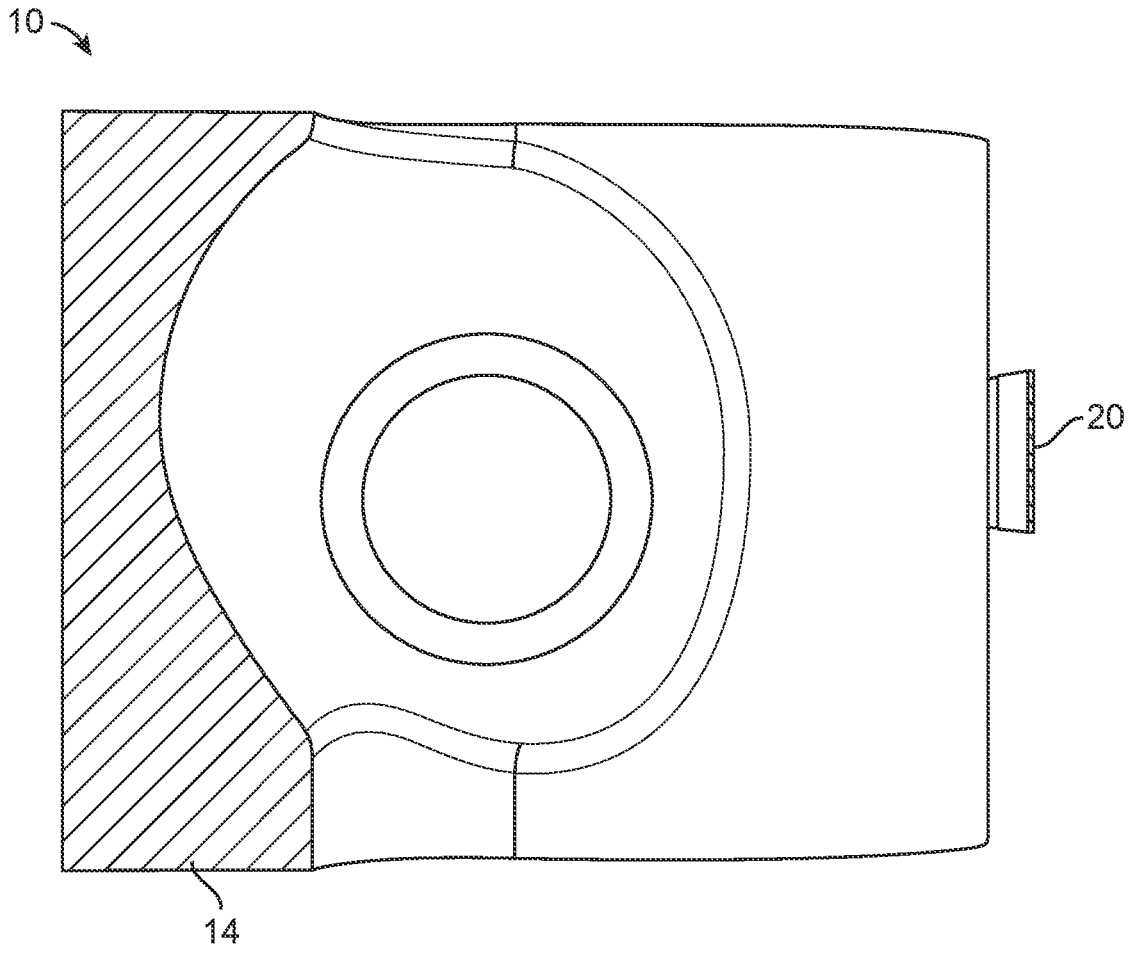
Figure 7:
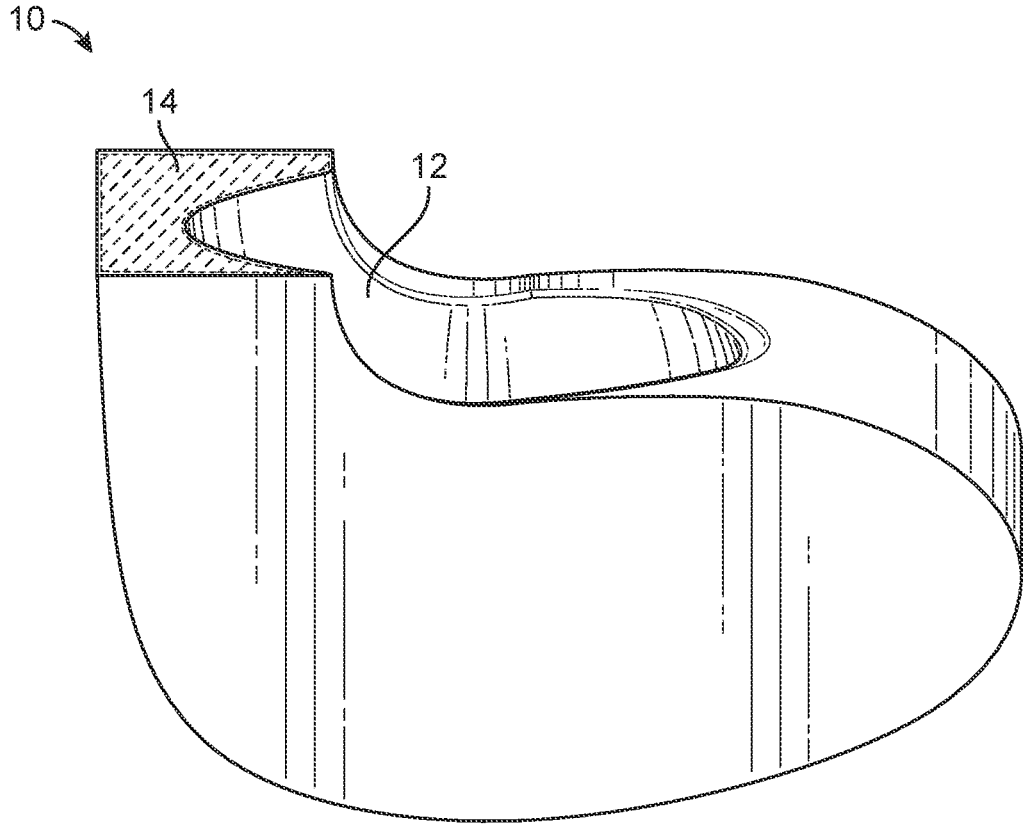
FIG. 7 is a slightly skew cross-sectional view of FIG. 6, in accordance with the present disclosure.

With reference to FIGS. 6A-9, embodiments of the headphones 10 are shown in cross-sectional. FIGS. 6A and 7 illustrate an embodiment of the headphones 10 that includes a cover 12 over the speakers. FIG. 6B illustrates an embodiment of the headphones 10 without a cover over the speakers 40.

Figure 5:
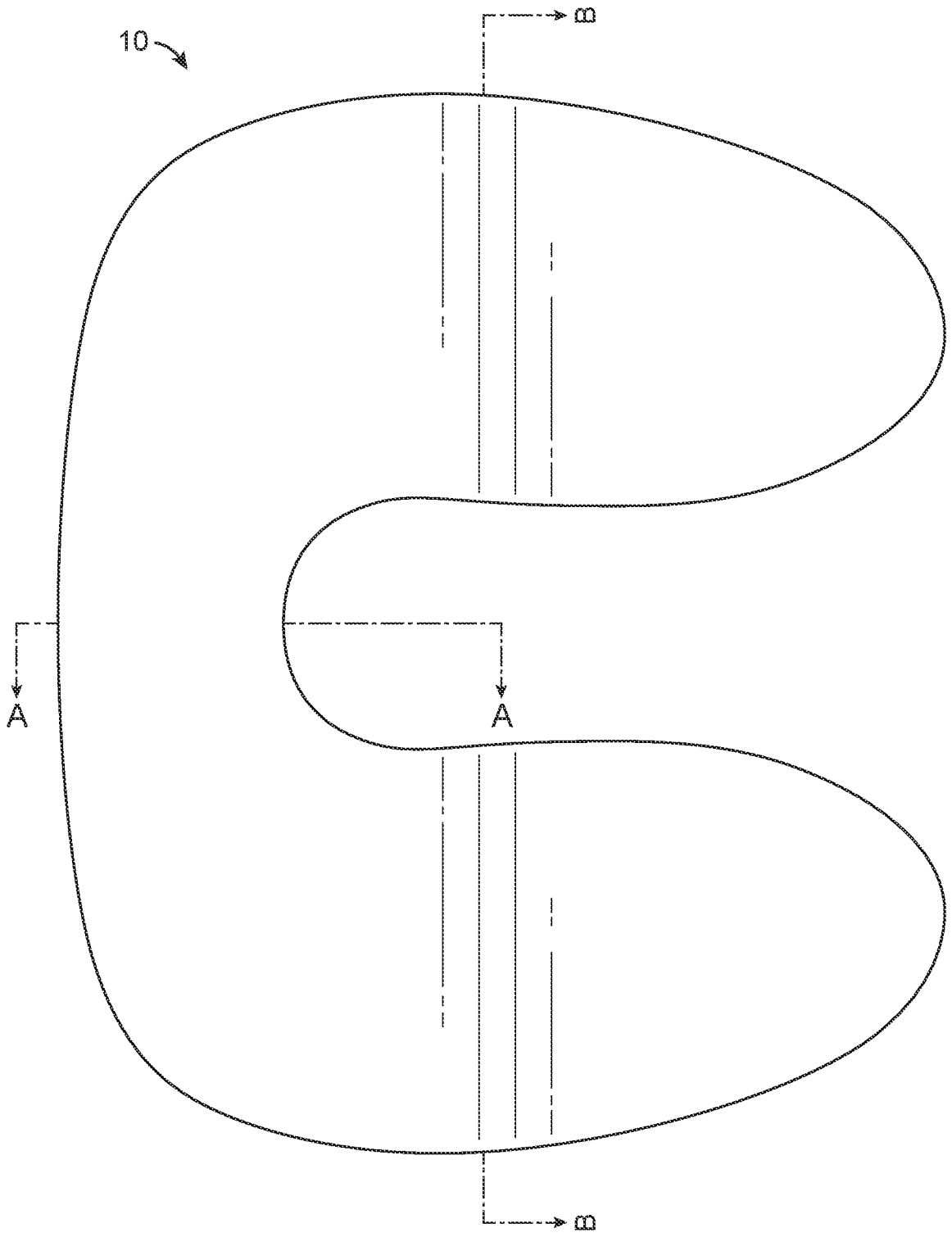
FIG. 5 is a top view of the exemplary headphones, in accordance with the present disclosure.
Figure 8:
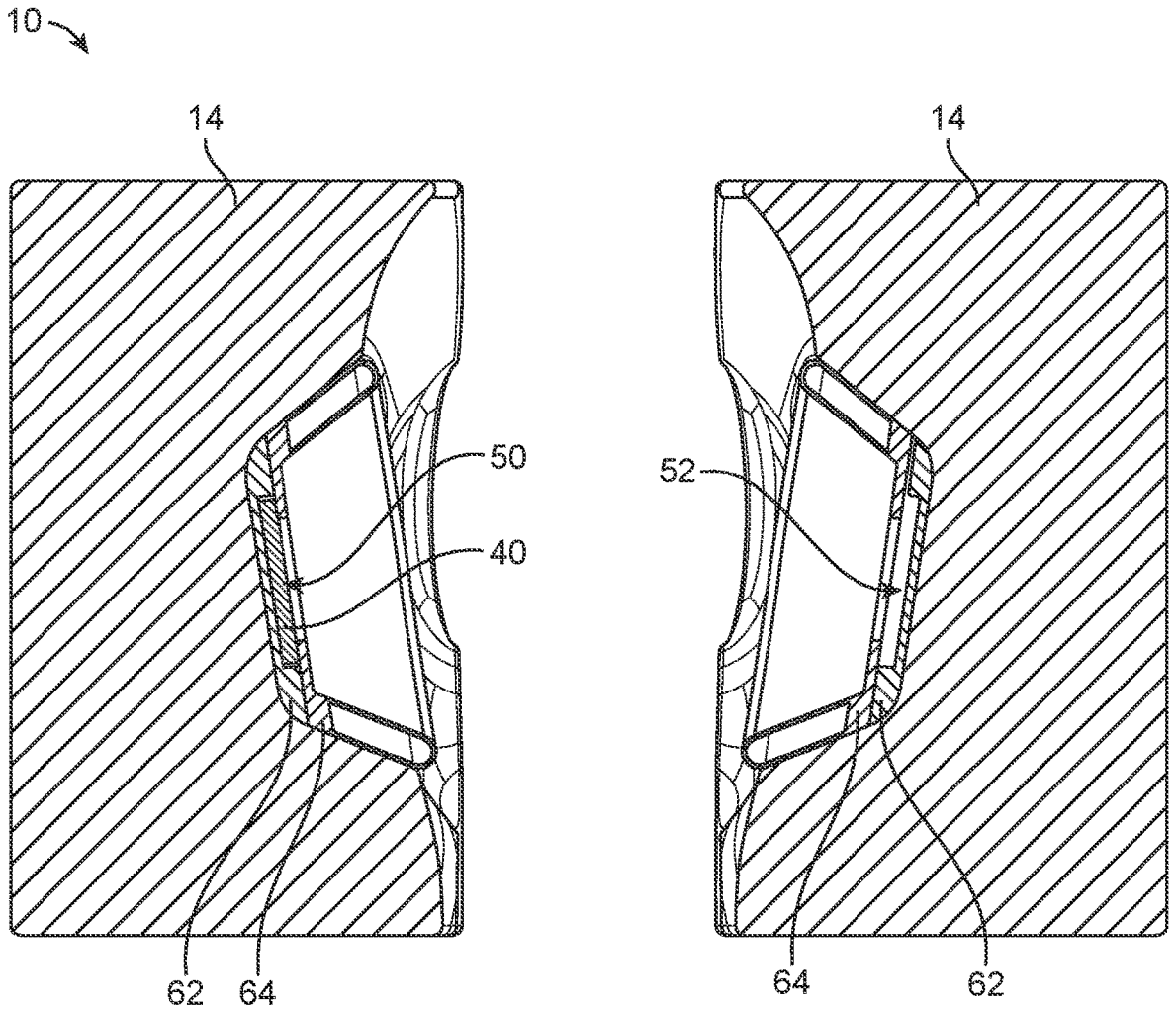
FIG. 8 is a cross-sectional views along the line B-B of FIG. 5, in accordance with the present disclosure.
Figure 9:
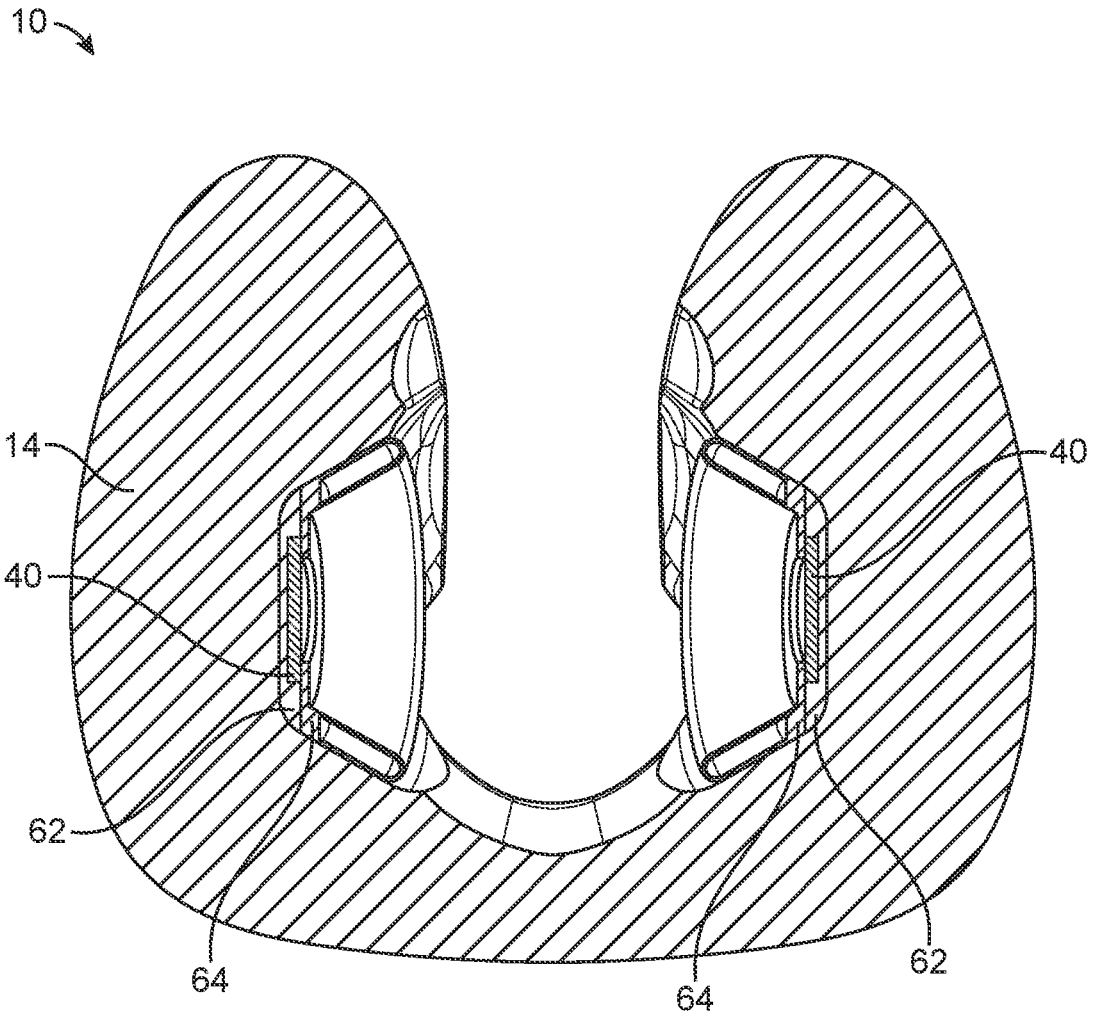
FIG. 9 is a cross-sectional view along the line C-C of FIG. 2, in accordance with the present disclosure.
Figure 10:
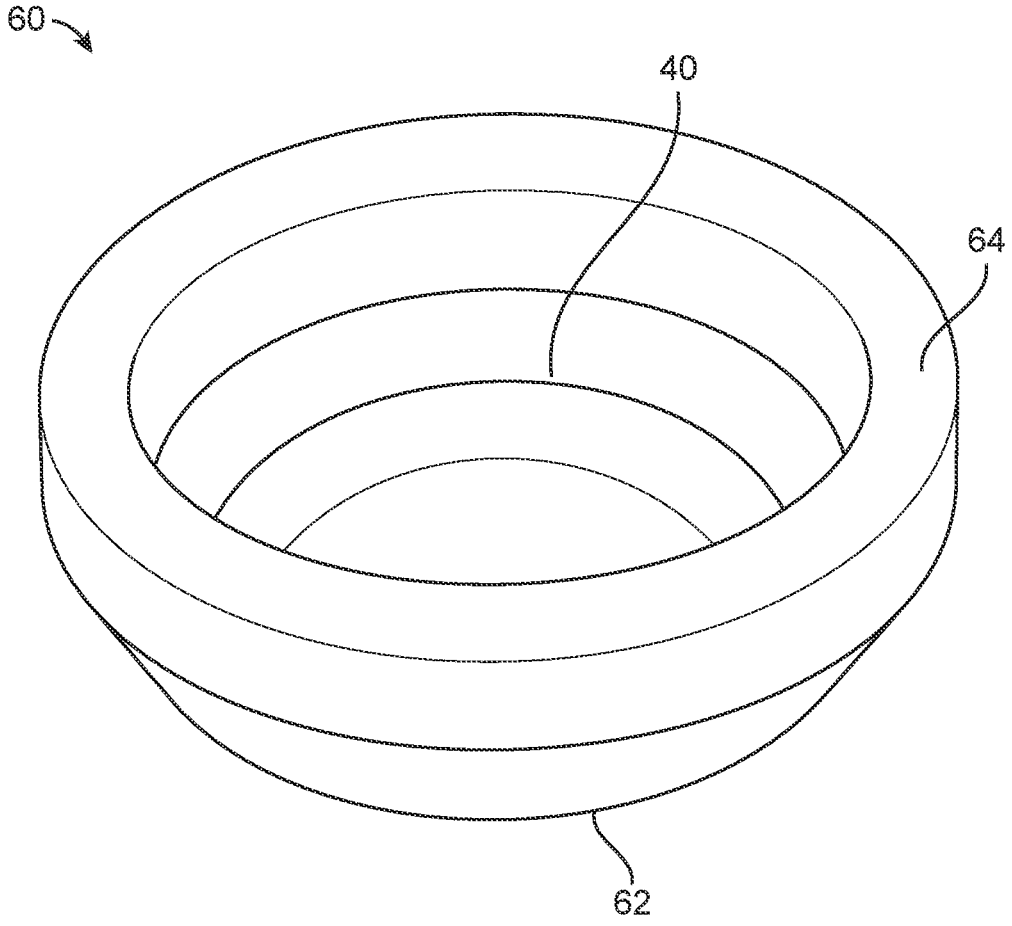
FIGS. 10-14 show various views of an exemplary noise attenuating structure, in accordance with the present disclosure.
Figure 11:
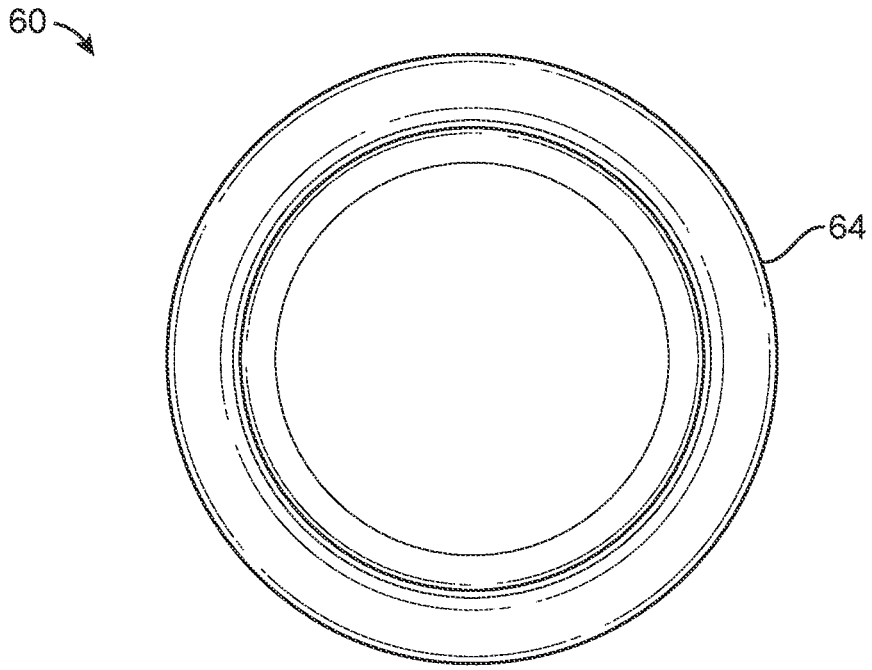
Figure 12:
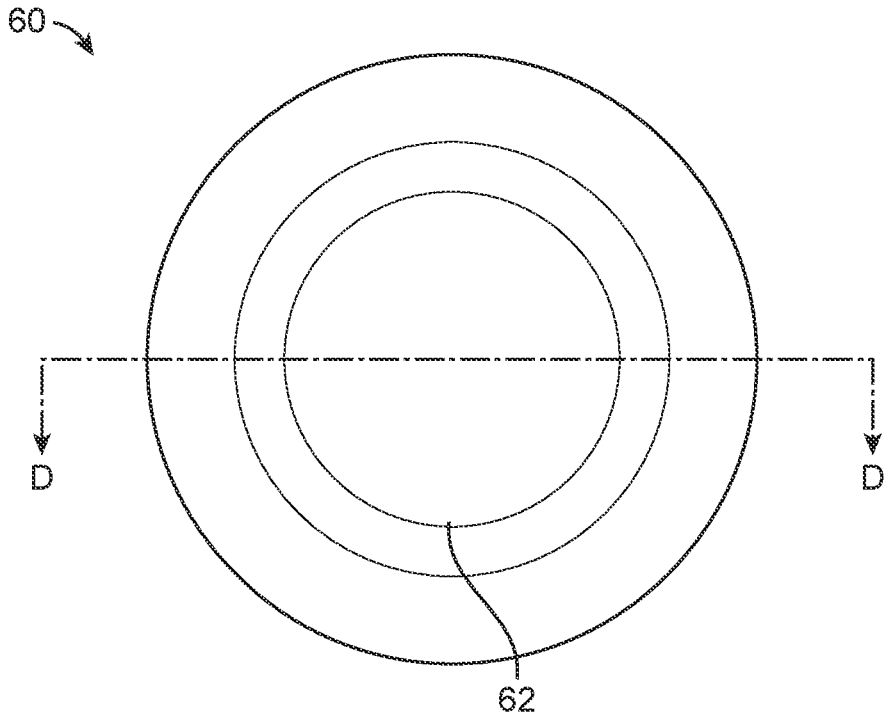
Figure 13:
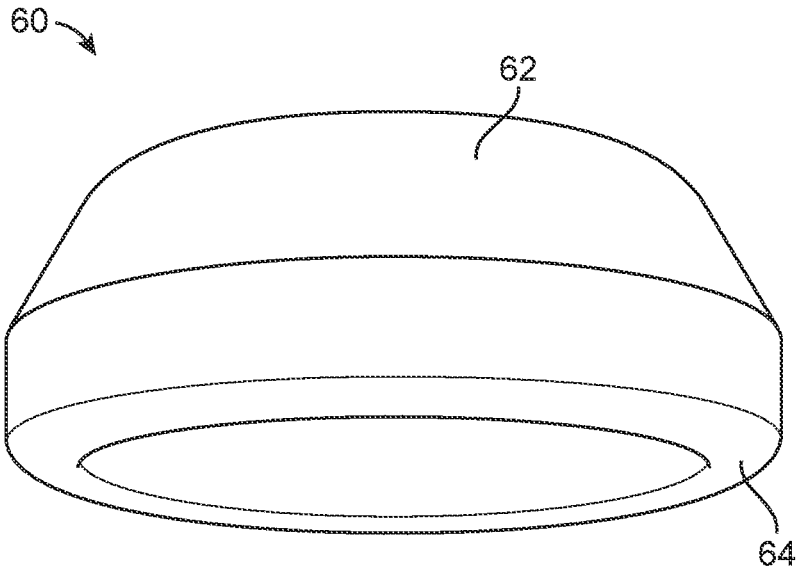
Figure 14:
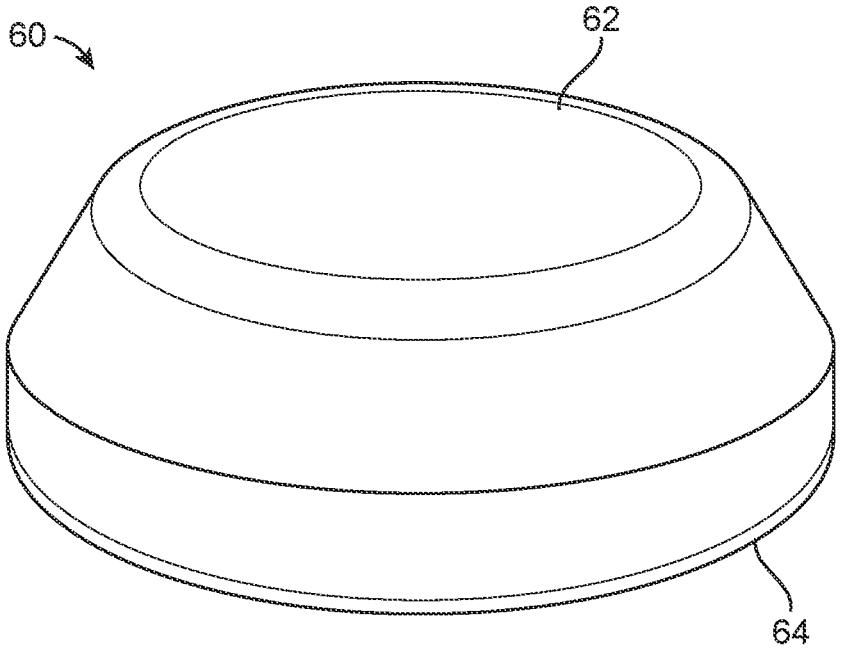

FIG. 8 is a cross-sectional view along the line B-B of FIG. 5, depicting an embodiment of the headphones 10 with the speaker 40 in an alternate position. FIG. 9 is a cross-sectional view along the line C-C of FIG. 2.

FIGS. 8-9 show a speaker 40 in a first cavity 50. The second cavity 52 is shown without a speaker to illustrate an exemplary cavity for housing the speaker. The first and second cavities 50 and 52 may be formed to be mirrored with respect to one another. Various electrical components including, e.g., wires, are excluded from the drawings for ease of description, as it would be apparent to those skilled in the art upon a careful reading of the teachings herein how to incorporate such features to power and control the speakers. One skilled in the art will readily recognize that embodiments of the headphones 10 disclosed herein may be controlled wirelessly to reduce internal components and that a battery and/or control module could be embedded within the structure away from where a user would rest their head.

In various embodiments, the headphones 10 include an exterior cover 12. The cover 12 can be form fitting. The cover 12 can be formed of one or more different materials. For example, the cover 12 can have a first fabric within inner regions intended for contact with a user's head and a second fabric elsewhere. In various embodiments, the cover 12 can have apertures over the speakers 40. In various embodiments, the cover 12 is removeable, e.g., includes a zipper or tuck-in folds for securing. The cover 12 can have varying thickness relative to different regions, e.g., a thinner thickness within inner regions intended for contact with a user's head and a second thickness elsewhere.

The headphones 10 include an ergonomic support structure 14 that acts to comfortably support a user's head and neck, while laying on their side, house and support the speakers 40, and noise attenuating structure 60, and any electrical components, and encompass the user's ears for noise mitigation. The support structure 14 is preferably sized and shaped to include the first and second void regions 50 and 52 to house the speakers 40 and the noise attenuating structure 60. An interior region of the support structure 14 is size and adapted to receive a user's head and therefore may be partially head-shaped. In one embodiment, the interior region of the support structure 14 is partially recessed, i.e., concaved, around the first and second void regions 50 and 52. The ergonomic support structure 14 may be pillow-like in structure and comfort.

The support structure 14 may be formed of one or more material types that are capable of suitably distributing pressure from a user's head and neck, or portion thereof, including, but not limited to, latex, foam, reticulated or non-reticulated visco-elastic foam (sometimes referred to as memory foam or low-resilience foam), reticulated or non-reticulated non-visco-elastic foam, polyurethane high-resilience foam, expanded polymer foams (e.g., expanded ethylene vinyl acetate, polypropylene, polystyrene, or polyethylene), and the like. The material preferably has a sufficient density and hardness for supporting the head and neck of the user, comfortably.

In various embodiments, the support structure 14 may be formed of materials having different densities, such as a first visco-elastic foam having a first density and a second visco-elastic foam having a second density. One skilled in the art will readily recognize that the selection of a visco-elastic foam having a particular density will affect other characteristics of the foam, including its hardness, the manner in which the foam responds to pressure, and the overall feel of the foam, but it is appreciated that a visco-elastic foam having a desired density and hardness can readily be selected for the an exemplary headphones 10 as desired.

The first and second void regions 50 and 52 can be most any size or shape to secure the speakers 40 and noise attenuating structure 60. In one embodiment, the first and second void regions 50 and 52 can be semi-spherical-shaped or partially, semi-spherical-shaped. In one embodiment, the first and second void regions 50 and 52 can be substantially conical-shaped, partially conical-shaped, or substantially frustoconical-shaped.

As FIGS. 8 and 9 show, the noise attenuating structure 60 can be secured within the first void region 50. Another noise attenuating structure 60 is preferably secured within the second void region 52, which is not shown for in the figures for illustrative purposes. As shown, the noise attenuating structure 60 is configured to receive the speaker 40, which can be secured substantially centrally.

The noise attenuating structure 60 is preferably secured within the first and second void regions 50 and 52. The noise attenuating structure 60 may be secured within the first and second void regions 50 and 52 using an adhesive layer, for example. The speaker 40 can be secured to the noise attenuating structure 60 using adhesive layer. The cover 12 can be secured over the speaker 40 and the noise attenuating structure 60.

Figure 15A:
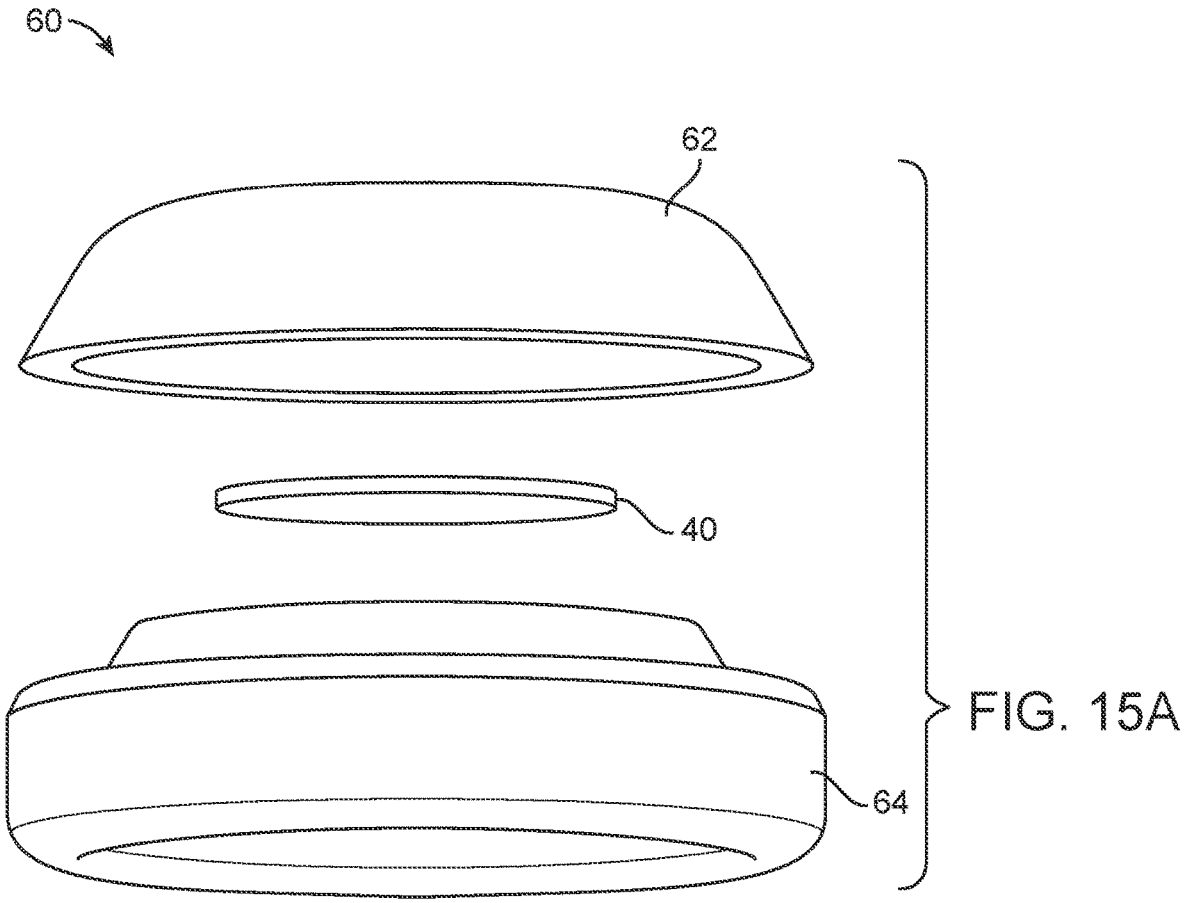
FIGS. 15A-15C show exploded views of the noise attenuating structure, in accordance with the present disclosure.
Figure 15B:
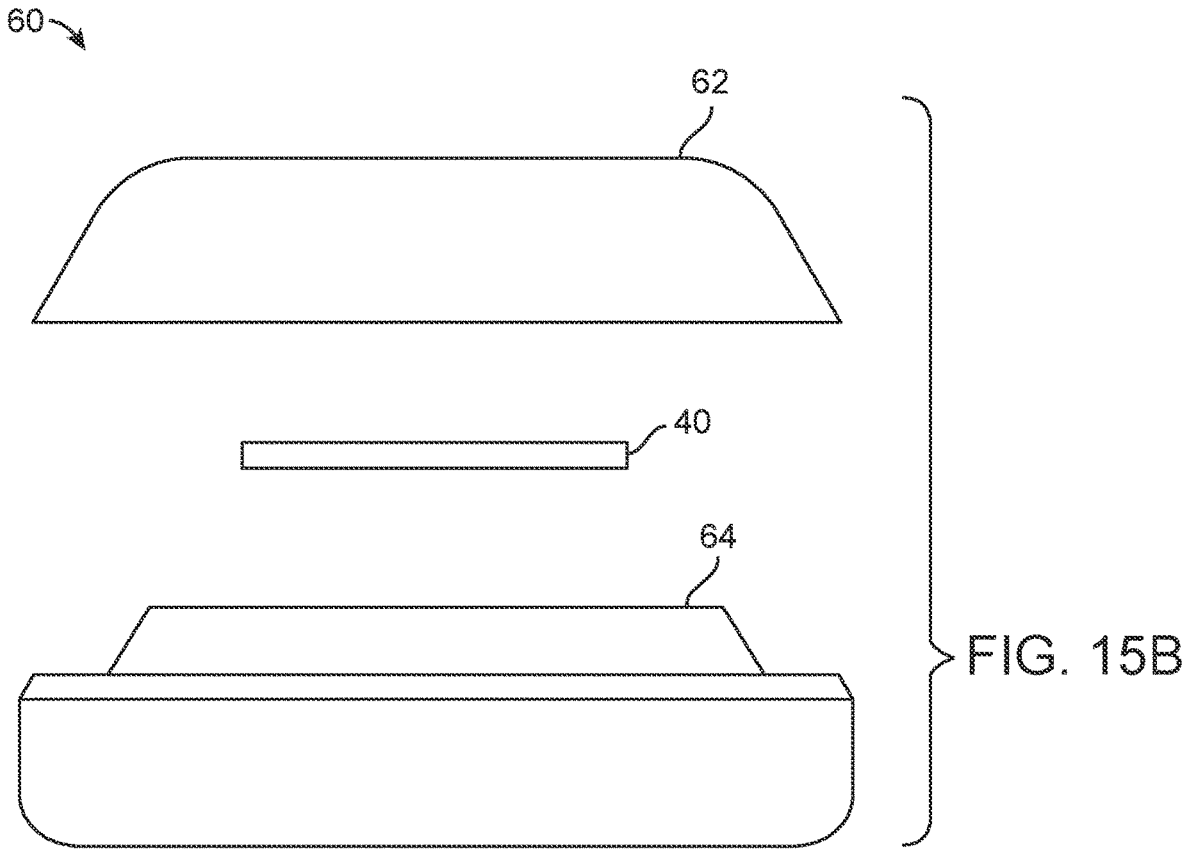
Figure 15C:
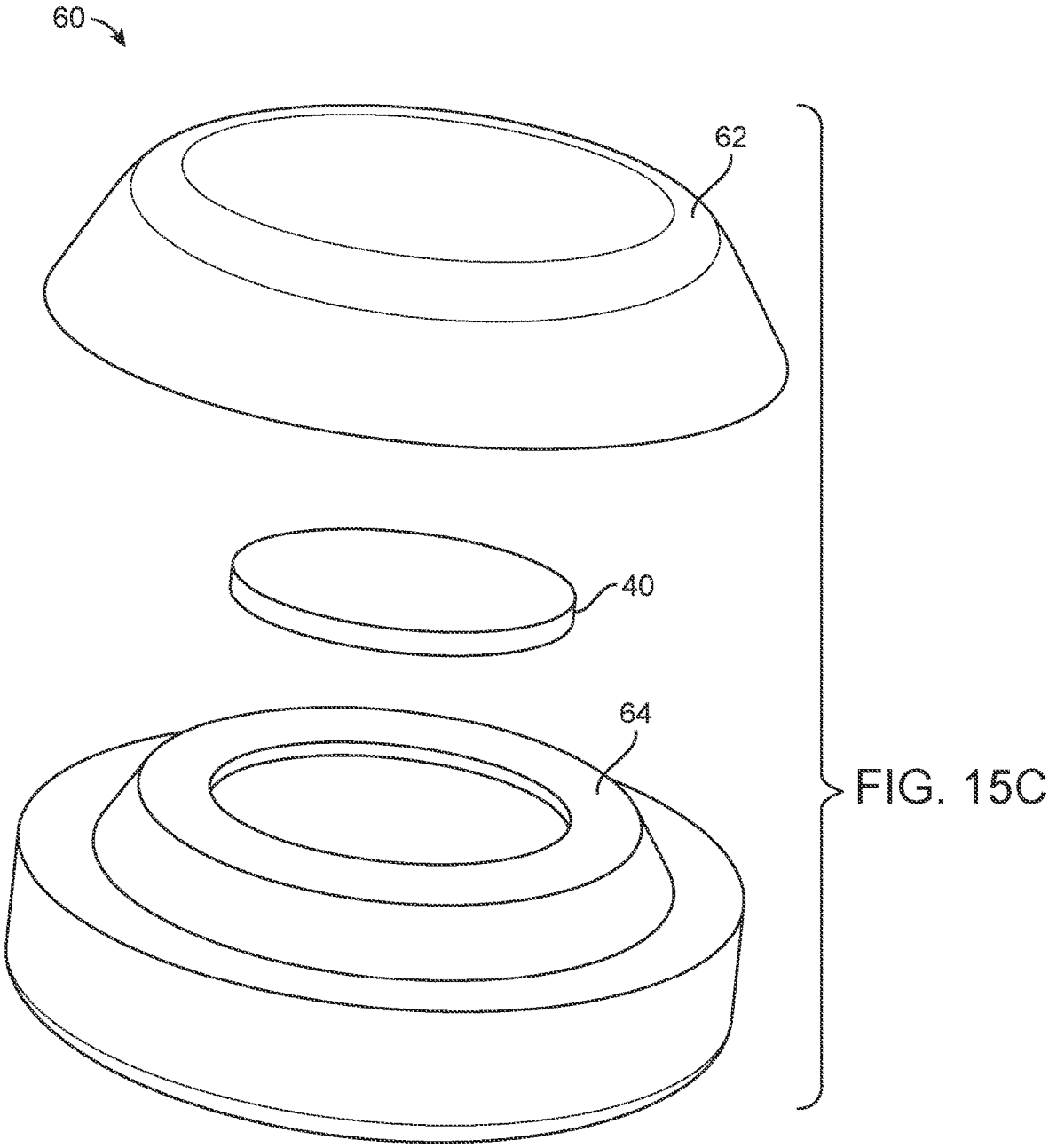
Figure 16:
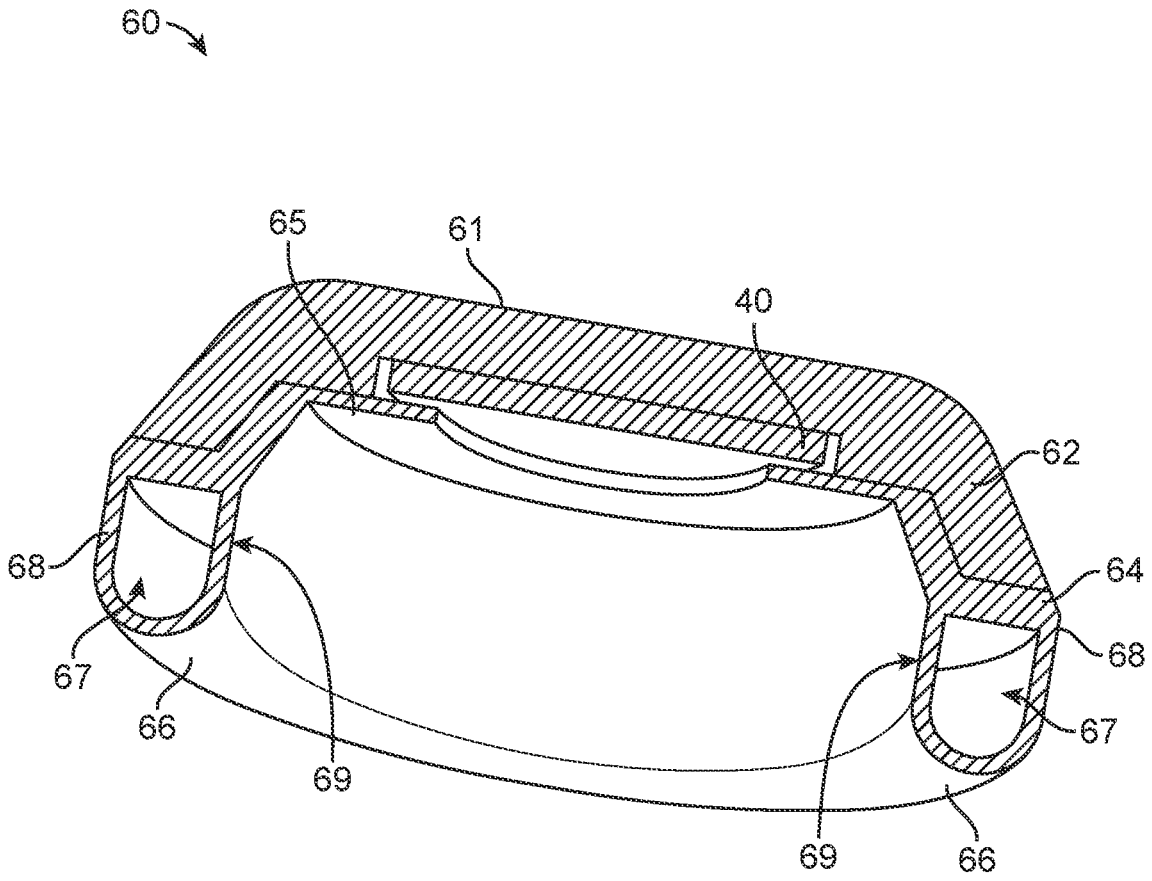
FIG. 16 is a cross-sectional view of the noise attenuating structure along the line D-D of FIG. 12, in accordance with the present disclosure.
Figure 17:
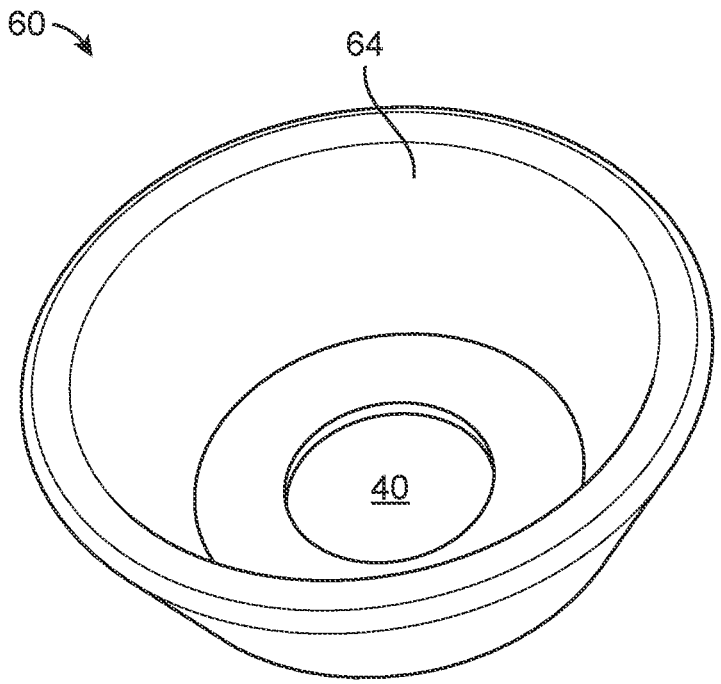
FIGS. 17-22 show another embodiment of the noise attenuating structure, in accordance with the present disclosure.
Figure 18:
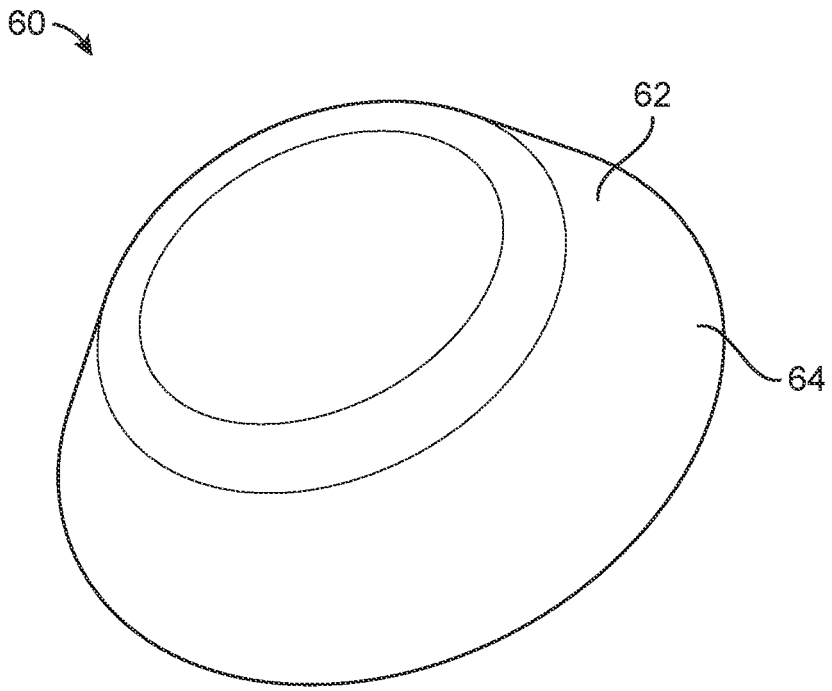
Figure 19:
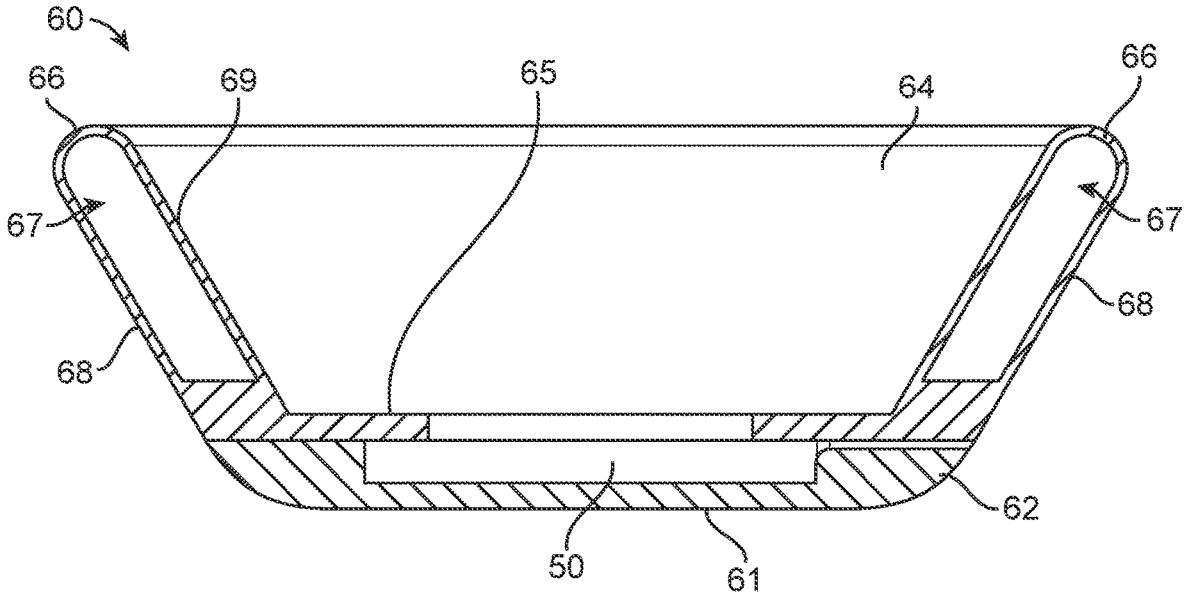
Figure 20:
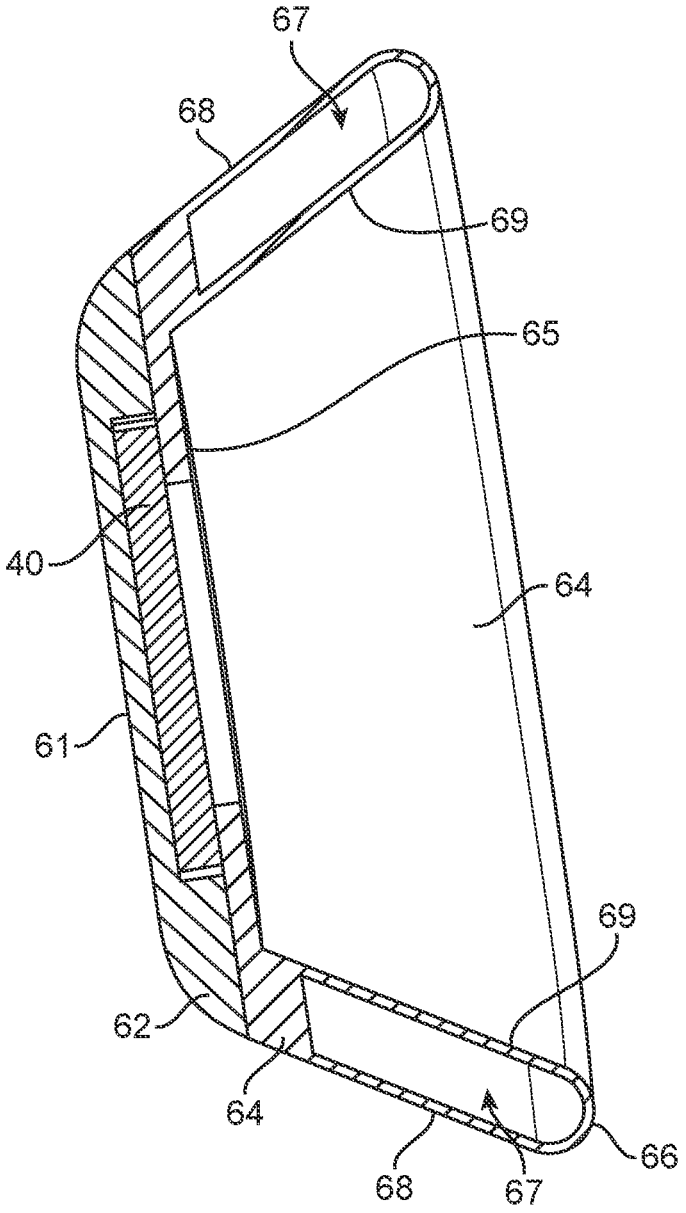
Figure 21:
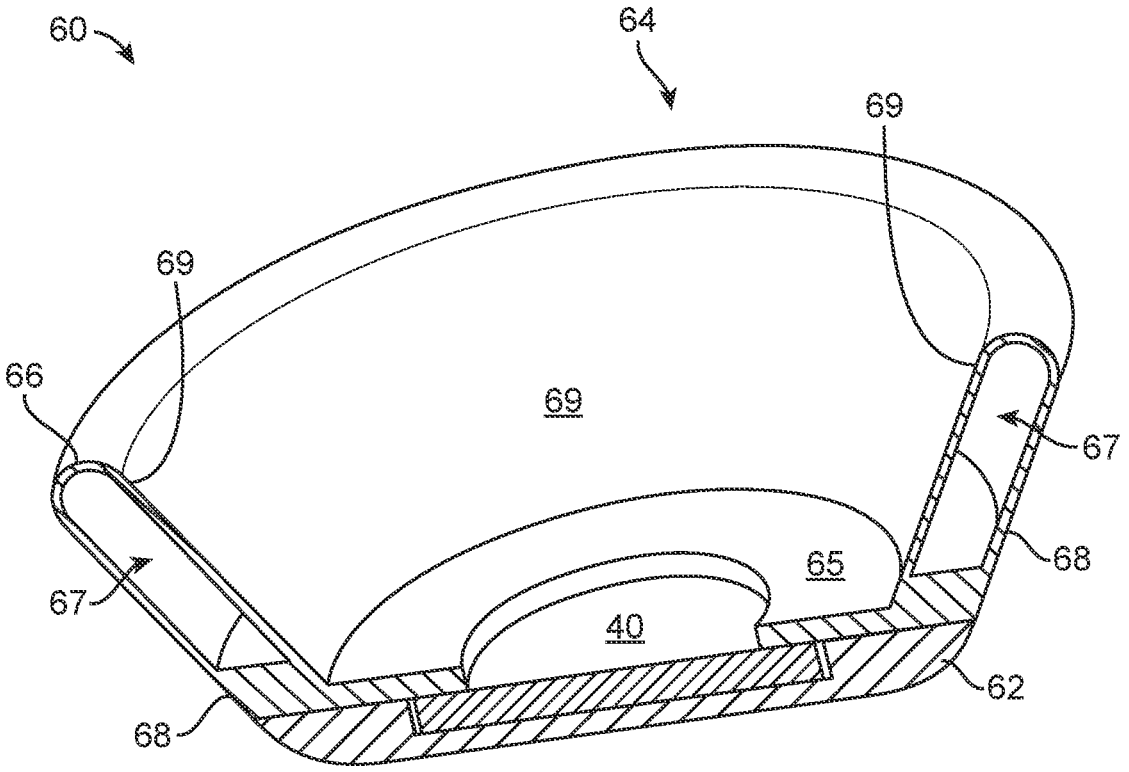
Figure 22:
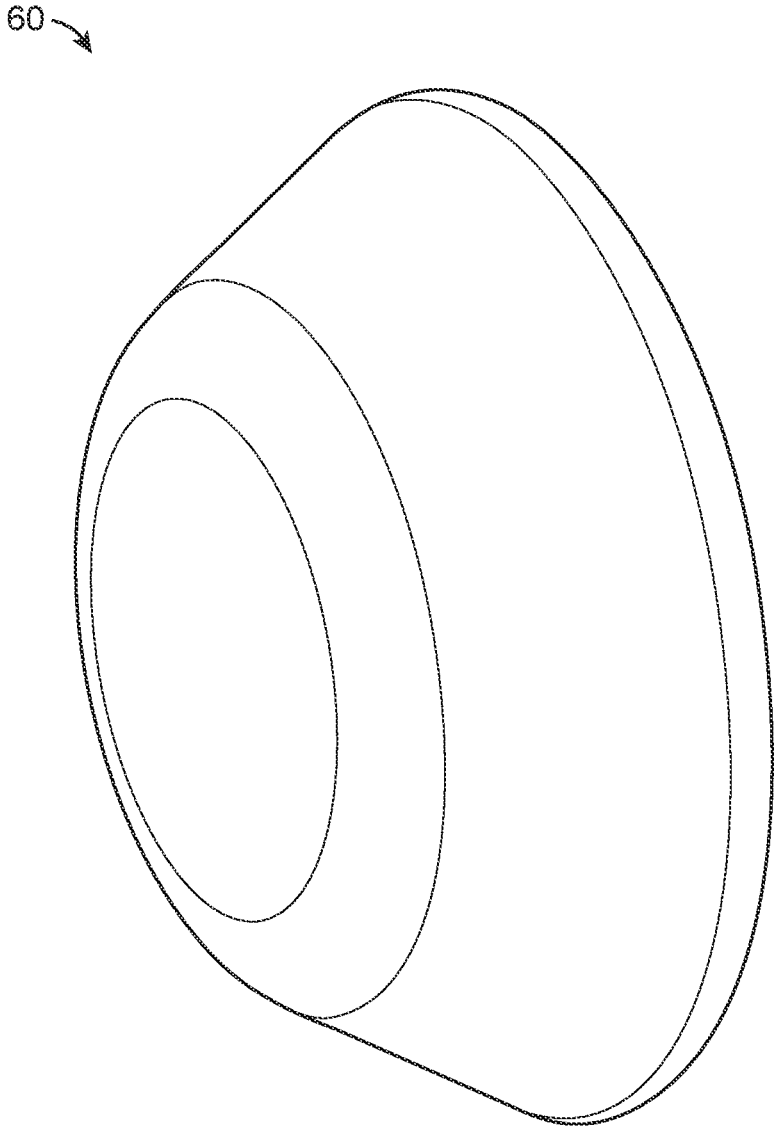
Figure 23:
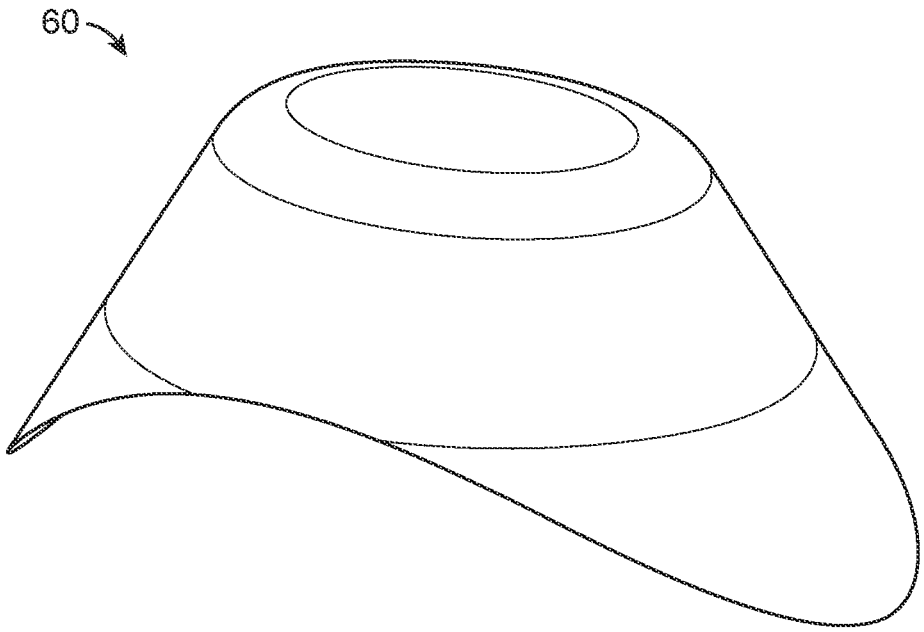
FIGS. 23-29 show yet another embodiment of the noise attenuating structure, in accordance with the present disclosure.
Figure 24:
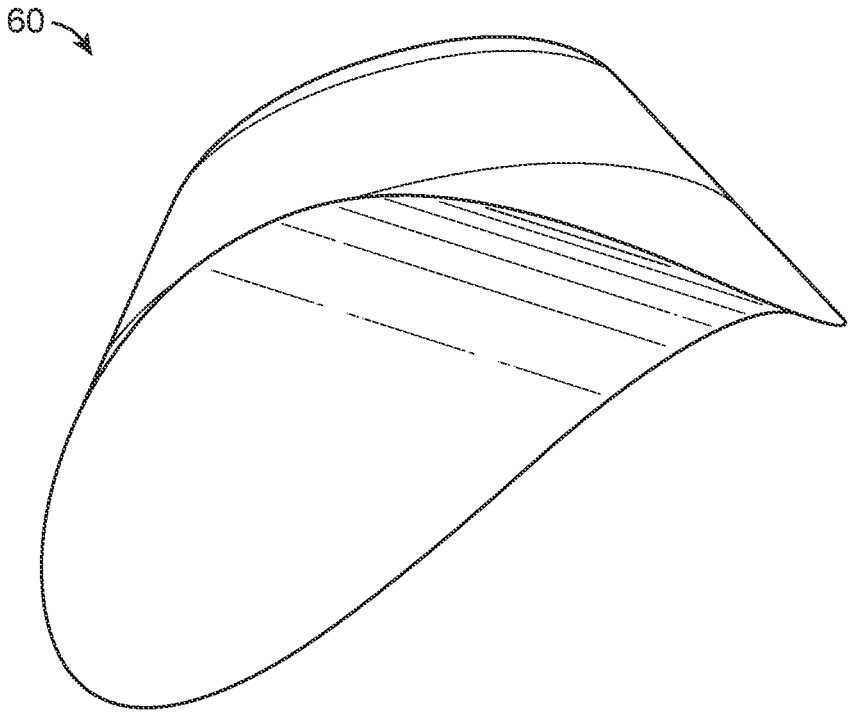
Figure 25:
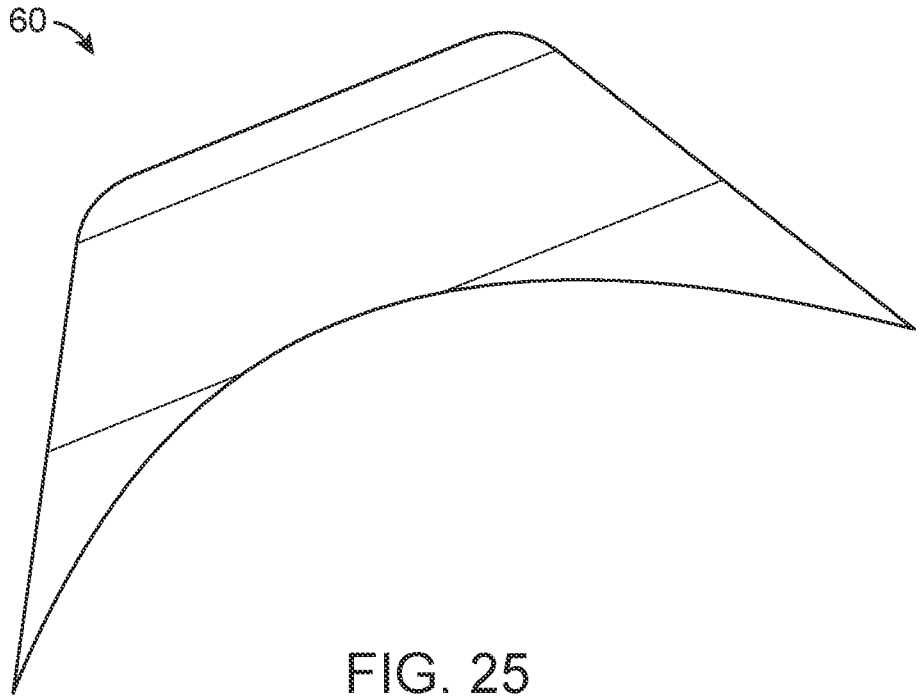
Figure 26:
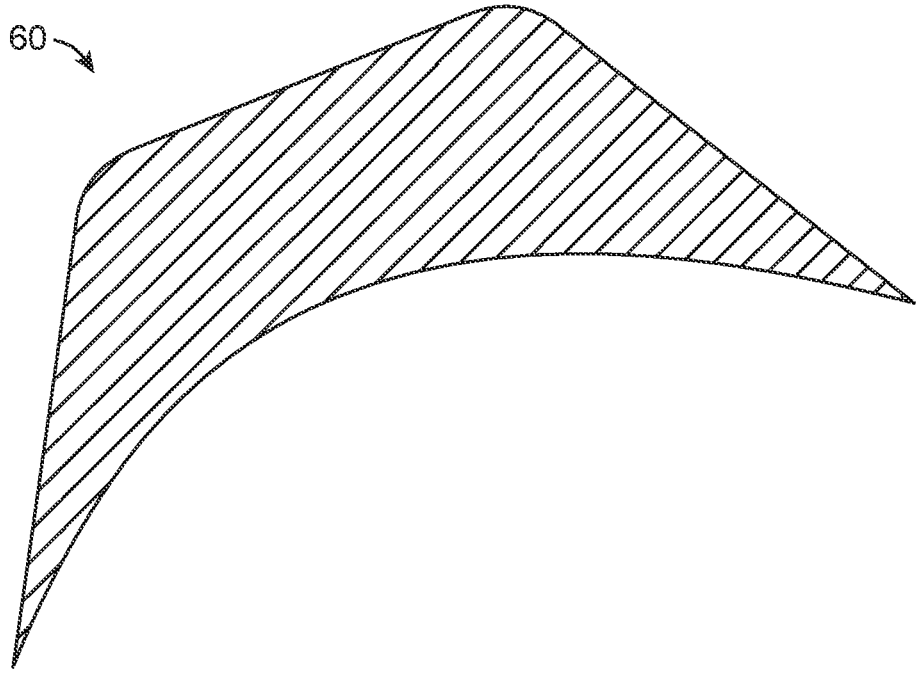
Figure 27:
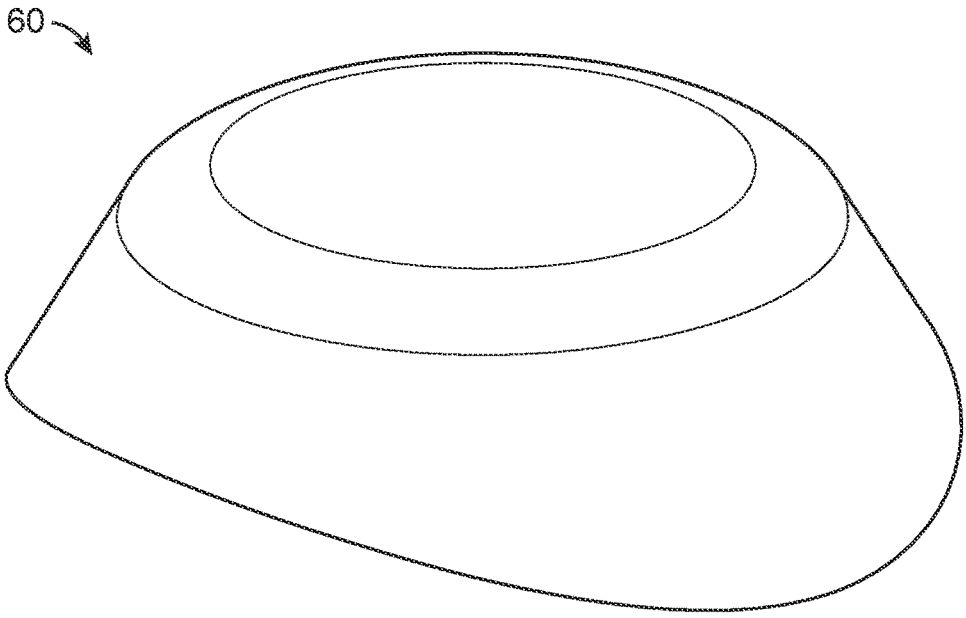
Figure 28:
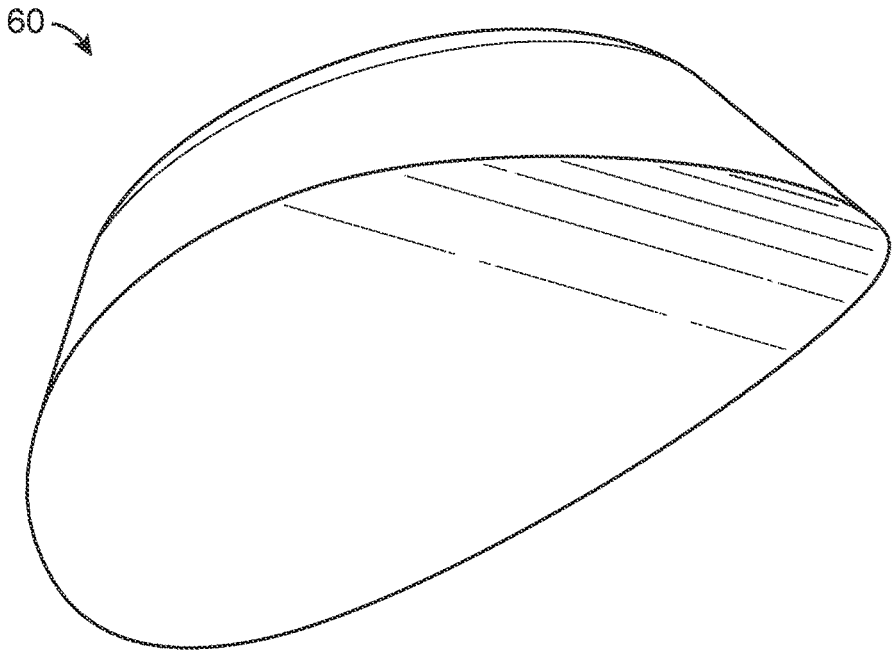
Figure 29:
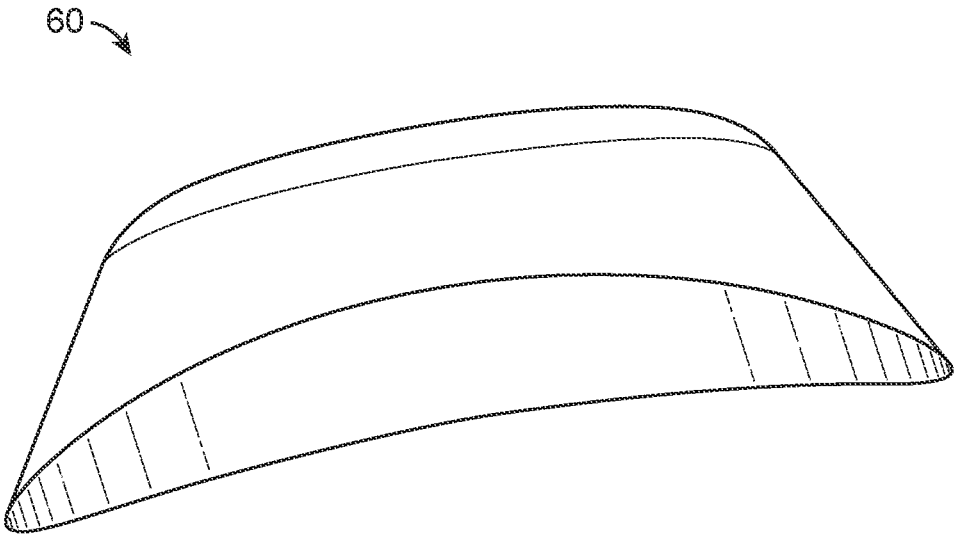

FIGS. 10-14 show various views of the exemplary noise attenuating structure 60 in an assembled state. FIGS. 15A-15C show exploded views of the noise attenuating structure 60. FIG. 16 is a cross-sectional view of the noise attenuating structure 60 along the line D-D of FIG. 12. The speaker 40 is shown schematically for ease of illustration and description. As FIGS. 10-16 show, the noise attenuating structure 60 is sized and shaped to fully encompass the ears of a user. The noise attenuating structure 60 is shown as formed from a base support component 62 and a head coupling portion 64, however it is contemplated herein that the noise attenuating structure 60 may be formed by a single integral component.

The base support component 62 is sized and shaped to receive the head coupling portion 64. In one embodiment, base support component 62 is sized and shaped to have a void space between the base support component 62 and the head coupling portion 64 in order to contain the speakers 40. The exterior portion of the base support component 62 is preferably sized and shaped to couple to interior surfaces of the first and second void regions 50 and 52. The base support component 62 can have a dome or semi-spherical-shaped interior. In one embodiment, the interior is substantially conical-shaped, partially conical-shaped, partially cylindrical-shaped, and/or substantially frustoconical-shaped.

In one embodiment, wires for the speaker 40 can be bored through the support structure 14 and through a bottom surface 61 of the base support component 62. In this way, any firmness attributed to the wires would be disbursed by the base support component 62 and the head coupling portion 64 when a user is laying on their side. In some embodiments, the wires for the speaker 40 can be bored through sides of the base support component 62 or can be inserted between the base support component 62 and the head coupling portion 64, e.g., inserted within a pre-bored inlet formed on a surface of the base support component 62 and/or the head coupling portion 64. In one embodiment, the battery may be positioned within the support structure for wireless charging.

The head coupling portion 64 preferably includes an exterior surface sized and shaped to couple to the interior portion of the base support component 62. The head coupling portion 64 may be coupled to the interior portion of the base support component 62 using a thin, non-contiguous layer of adhesive. The head coupling portion 64 can have a dome, cupped, or semi-spherical-shaped interior. In one embodiment, the interior is substantially conical-shaped, partially conical-shaped, partially cylindrical-shaped, and/or substantially frustoconical-shaped. In one embodiment, the interior of the head coupling portion 64 has a lower portion that is substantially frustoconical-shaped and a top portion that is substantially cylindrical-shaped. In one embodiment, the head coupling portion 64 includes a lower surface 65 that is preferably circular-shaped and includes an aperture from which sound from the speaker 40 may be directed therethrough.

A circumferential end 66 is sized and shaped to fully encompass the ears, i.e., the circumferential end 66 is configured to press against a user's head, surrounding the ears when in use. The circumferential end 66 partially deforms, or collapses, when pressed, as a function of its hollow interior 67 and material type. In this way, the end may better couple to the user's head. The circumferential end 66 and hollow interior 67 returns to its original shape when removed from pressure, e.g., after being removed from a user's head.

The hollow interior 67 is preferably an annular void space just below the circumferential end 66 and defined by an exterior surface 68 and an interior surface 69. The hollow interior 67 may have any number of cross-sectional shapes including circular or non-circular cross-sectional shapes. In one embodiment, the hollow interior 67 has a rectangular cross-sectional shape with a rounded top, such as shown in FIG. 16. In one embodiment, the hollow interior 67 is substantially congruent with the exterior shape formed from the circumferential end 66, the exterior surface 68, and the interior surface 69. In this way, the hollow interior 67 can be formed by a wall having a substantially consistent thickness.

The noise attenuating structure 60 may function to: (1) attenuate ambient noise exterior to the headphones 10; (2) keep sound originating from the speaker 40 from propagating exterior to the headphones 10; and (3) mitigate pressure on the ears when a user is laying on their side. By having the noise attenuating structure 60 formed of two primary components materials may be selected for both components that have different properties.

The base support component 62 and/or the head coupling portion 64 of the noise attenuating structure 60 may be formed from an elastomer material, such as silicone or silicone rubber. In various embodiments, the base support component 62 and/or the head coupling portion 64 may be formed from materials including, but not limited to including, polyurethane (PU) foam, PU foam with a silicone skin, silicone gel with a silicone rubber skin, PU foam with a PU skin, silicone foam, or a thermoplastic (TPE) foam. In one embodiment, any relatively slow-rebounding material which may be deformed and then expand to conform to an original geometry may be used to form the head coupling portion 64.

In one embodiment, the noise attenuating structure 60 is formed of a base support component 62 having a firmness that is greater than the head coupling portion 64. The base support component 62 can be formed of a material have an elasticity that is less than a material forming the head coupling portion 64. In one embodiment, the base support component 62 is formed of material having a material density greater than a material forming the head coupling portion 64. In one embodiment, the base support component 62 is formed of a silicone material having a higher density than the silicone material forming the head coupling portion 64.

In this way, the base support component 62 can be rigid enough to hold the speaker 40 and head coupling portion 64 in place, but flexible and pliable enough to permit the head coupling portion 64 to preferentially flex and move when engaged with a user's head.

In one embodiment, the speakers 40 can be positioned exterior to the noise attenuating structure 60, instead of housed within. In this way, sound may be propagated from the speakers 40 through the noise attenuating structure 60 to the user's ears. Alternatively, apertures from the speakers 40 to the user's ear may be formed on the noise attenuating structure 60, e.g., bored through the base support component 62 and/or the head coupling portion 64. The speakers 40 may be adhered to a bottom surface base support component 62 for securing in place.

FIGS. 17-22 show another embodiment of the noise attenuating structure, in accordance with the present disclosure. As FIGS. 17-22 show, side walls of the head coupling portion 64 may be more positioned at a different angle compared with the embodiment shown in FIG. 16, for example. The bottom surface base support component 62 may also be configured to receive the head coupling portion 64 in a different configuration.

FIGS. 23-29 show yet another embodiment of the noise attenuating structure. As FIGS. 23-29 show, the noise attenuating structure may be contoured to a user's head shape.

While the foregoing disclosure discusses illustrative embodiments, it should be noted that various changes and modifications could be made herein without departing from the scope of the described embodiments as defined by the appended claims. Accordingly, the described embodiments are intended to embrace all such alterations, modifications and variations that fall within scope of the appended claims. Furthermore, although elements of the described embodiments may be described or claimed in the singular, the plural is contemplated unless limitation to the singular is explicitly stated. Additionally, all or a portion of any embodiment may be utilized with all or a portion of any other embodiments, unless stated otherwise.

The invention claimed is:

1. Ambient noise attenuating headphones comprising:

an ergonomic support structure;

a noise attenuating structure housed within the ergonomic support structure having a circumferential end configured to surround an ear of the user, wherein the noise attenuating structure comprises a first and second elastic portion, wherein the first elastic portion comprises an annular interior surface configured to couple to an exterior portion of the second elastic portion, and wherein the second elastic portion has the circumferential end having a material density less than the first elastic portion; and a speaker coupled to the noise attenuating structure.

2. The headphones of claim 1, wherein the circumferential end of the second elastic portion has a hollow interior.

3. The headphones of claim 1, wherein the first and second elastic portions comprise a void space for housing the speaker within the noise attenuating structure.

4. The headphones of claim 1, wherein the second elastic portion comprises an interior space that is partially frustoconical-shaped.

5. The headphones of claim 4, wherein the circumferential end of the second elastic portion has a hollow interior partially defined by the interior space.

6. The headphones of claim 5, wherein the hollow interior is annular, having a partially rounded cross-sectional shape.

7. Ambient noise attenuating headphones comprising:

an ergonomic support structure configured to support a head and neck of a user;

a noise attenuating structure housed within the ergonomic support structure having a circumferential end configured to surround an ear of the user, wherein the noise attenuating structure comprises a first and second elastic portion formed of an elastomer material, wherein the first elastic portion comprises an annular interior surface configured to couple to an exterior portion of the second elastic portion, and wherein the second elastic portion has the circumferential end having an elasticity greater than the first elastic portion; and a speaker coupled to the noise attenuating structure.

8. The headphones of claim 7, wherein the second elastic portion comprises an interior space that is partially frustoconical-shaped.

9. The headphones of claim 8, wherein the circumferential end of the second elastic portion has a hollow interior partially defined by the interior space.

10. The headphones of claim 9, wherein the hollow interior is annular, having a partially rounded cross-sectional shape.

11. The headphones of claim 8, wherein the second elastic portion is formed of a slow-rebounding material.

12. Ambient noise attenuating headphones comprising:

an ergonomic support structure formed of elastic foam, configured to support a head and neck of a user, wherein the ergonomic support structure comprises an interior space shaped to receive a user's head;

a noise attenuating structure housed within the ergonomic support structure having a circumferential end configured to surround an ear of the user, wherein the noise attenuating structure comprises a first and second elastic portion formed of an elastomer material, wherein the first elastic portion comprises an annular interior surface configured to couple to an exterior portion of the second elastic portion, and wherein the second elastic portion comprises an interior space that is partially frustoconical-shaped and comprises a substantially circular base having at least one aperture to the speaker, and wherein the second elastic portion has the circumferential end having an elasticity greater than the first elastic portion, and wherein the interior space shaped to receive a user's head comprises a void space for housing the noise attenuating structure;

a speaker embedded within the noise attenuating structure; and a cover over the ergonomic support structure and the noise attenuating structure.

13. The headphones of claim 12, wherein the circumferential end of the second elastic portion has a hollow interior partially defined by the interior space, wherein the hollow interior is annular, having a partially rounded cross-sectional shape.

14. The headphones of claim 12, wherein the second elastic portion is formed of a slow-rebounding material.

15. The headphones of claim 12, wherein the elastomer material is a silicone material, and wherein the first elastic portion has a material density greater than the second elastic portion.

16. The headphones of claim 15, wherein the ergonomic support structure is a pillow.

* * * * *